United States Patent [19]

Roper

[11] Patent Number: 4,550,802

[45] Date of Patent: Nov. 5, 1985

[54] FOOTSTOOL WITH INCLINED RAMP

[76] Inventor: Colleen F. Roper, 8935 W. Peoria Ave., Peoria, Ariz. 85345

[21] Appl. No.: 687,950

[22] Filed: Dec. 31, 1984

[51] Int. Cl.[4] ..... A47C 9/00

[52] U.S. Cl. ..... 182/113; 182/129; 182/230

[58] Field of Search ..... 182/113, 129, 106, 230; 272/144, 145; 312/235; 297/6; 14/71.1, 69.5; 254/88

[56] References Cited

U.S. PATENT DOCUMENTS

| | | | |
|---|---|---|---|
| D. 174,616 | 5/1955 | Dixon | 182/106 |
| 1,855,949 | 4/1932 | Dubroca | 254/88 |
| 2,267,158 | 12/1941 | Locke | 34/90 |
| 2,272,334 | 2/1942 | Laurent | 254/88 |
| 2,563,436 | 8/1951 | Toth | 182/33.5 |
| 3,578,110 | 5/1971 | Seagraves | 182/106 |
| 3,606,253 | 9/1971 | Wooten | 254/88 |
| 3,856,264 | 12/1974 | Thumma | 254/88 |
| 3,857,561 | 12/1974 | Cecchettini | 272/144 |
| 3,870,277 | 3/1975 | West | 254/88 |

FOREIGN PATENT DOCUMENTS

| | | | |
|---|---|---|---|
| 56191 | 5/1967 | German Democratic Rep. | 272/144 |

*Primary Examiner*—Reinaldo P. Machado
*Attorney, Agent, or Firm*—Weiss & Holloway

[57] ABSTRACT

An improved footstool is disclosed which is useful for assisting medical patients to climb onto a medical equipment. The footstool includes a top with supporting legs which support the top above a floor surface. A removable incline ramp which stands from the floor to the top of the footstool and allow a patient to move up the ramp to the top without requiring a large upward step. Flat openings are provided on the top of the footstool to engage finger members which are attached to the upward end of the ramp. When in use, the ramp fingers are engaged with the flat openings in the footstool top. When not in use, the ramp in one embodiment, can be supported on a brace which extends across a railing which is attached to the edge of the footstool top.

19 Claims, 2 Drawing Figures

FOOTSTOOL WITH INCLINED RAMP

BACKGROUND OF THE INVENTION

This invention relates generally to a footstool, and more specifically to a footstool useful in medical applications with invalid patients and to a method for its use and such applications.

In many applications, especially in a medical field, a footstool is used to aid a person in climbing onto another piece of equipment such as an x-ray table, examination table, bed, or the like. The stool, having a height of a foot or so, provides the necessary elevation for the person to be able to then easily turn and mount the piece of equipment. For some persons having disabilities, for example from arthritis, stroke, and the like, it is difficult to step up onto the footstool. Raising the foot and leg for such a person maybe painful, difficult, or even impossible. The use of such a footstool, however, is necessary to avoid an attendant being required to lift that person onto the equipment.

In view of the need for some means to aid persons in climbing onto equipment, especially medical equipment, and in view of the inability of some persons to use conventional foostools, a need existed for an improved footstool which would be usable by even disabled persons.

It is therefore an object of this invention to provide an improved footstool which can be mounted by disabled persons.

It is a further object of this invention to provide a method for assisting disabled persons onto medical equipment.

It is another object of this invention to provide an improved footstool which can be mounted without raising the foot the full height of the footstool.

BRIEF SUMMARY OF THE INVENTION

The foregoing and other objects and advantages of the invention are achieved through the use of a footstool having an incline ramp attachable thereto. In accordance with one embodiment of the invention, the footstool includes a top, supporting legs which support the top a specified distance above the floor, and a removable incline ramp. The top of the footstool is provided with slot openings; the end of the ramp is provided with finger members which can be engaged with the slot openings to hold the ramp and at the level of the footstool top. In using the footstool, a medical patient or other user gradually moves up the ramp until he or she is able to reach a level on the footstool which facilitates climbing onto the equipment. The person can gradually move up the ramp without taking a single, large vertical step.

DETAILED DESCRIPTION OF PREFERRED EMBODIMENTS

There are a number of patents which disclose a support stand having an incline ramp leading to the top of the stand. It is included, for example, U.S. Pat. Nos. 1,855,949, 3,870,277, 3,856,264, 3,606,253, and 2,272,334 which all relate to a stand with an incline ramp for raising an automobile wheel off the ground. These techniques for raising an automobile are not obviously applicable to the situation of aiding a medical patient in climbing to a sufficient height to be able to then mount a piece of medical equipment. Also, U.S. Pat. No. 2,267,158 discloses a shoe fitting stool which includes a stool with an inclined side upon which a customer places his feet. Again, such a shoe fitting stool is not intended for and is not useful for aiding a medical patient for climbing onto a piece of medical equipment. U.S. Pat. No. 2,563,436 discloses a step ladder stool having a number of steps of moderate heights leading up to the top of the stool. A step ladder stool, as disclosed, is not useful for the medical patient, because it still requires the raising of his foot a considerable distance to mount each one of the individual steps.

Figure 1:
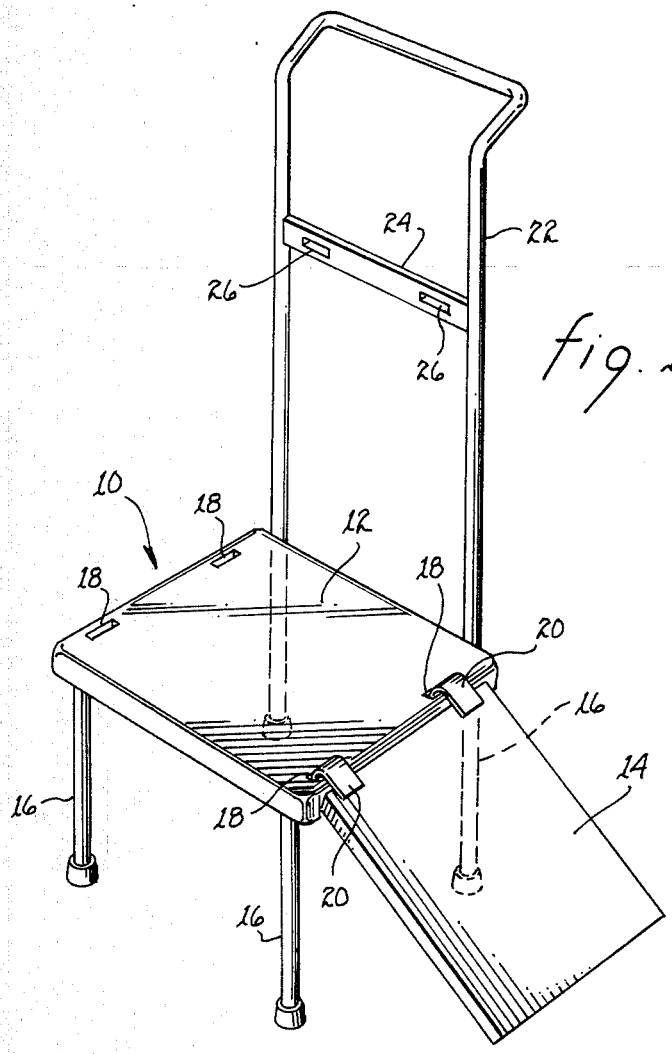
FIG. 1 is a perspective view of one embodiment of the invention depicting a ramp attached to a footstool and leading from the floor to the top of the footstool.

FIG. 1 is a perspective view of a stool, generally designated by reference number 10, which is useful for a medical patient or other person who must climb to the top of the stool without making a single, large, vertical step. The stool includes a step or step surface 12 and an inclined ramp 14. A plurality of legs 16 support the step 12 and positioned at a prescribed distance above the floor. Inclined ramp 14 then extends from the floor to the top of the step 12 surface. The step 12 can have a top surface area of about 12 by 12 square inches and can be positioned about 12 inches above the floor. The corresponding ramp 14 is about 12 inches in width and can have a length of about 18 to 24 inches to provide a gentle incline from the floor to the top of the step. Preferably four legs 16 are used to support the step and can be, for example, tubular steel or the like. In one embodiment, legs 16 comprise a u-shaped member which form two legs in pairs with the bottom of the u-shaped member being attached to the bottom of the step 12.

In the top surface of step 12 are a plurality of slot openings 18. Preferably, these slot openings are in pairs with one pair of slots on each of opposite sides of the step, as illustrated in FIG. 1. The end of ramp 14 is then provided with a pair of outwardly extending fingers 20 which can be placed in engagement with a pair of the slot openings 18. To hold the top of the ramp 14 at a level similar to the level of the top of step 12, the pair of slot openings 18 on opposite sides of the step allow the inclined ramp with the outwardly extending fingers 20 to be attached to either side of the stool 10.

In a preferred embodiment, the stool 10 also includes an upwardly extending handle and support railing 22. The hand railing 22 is, preferably, u-shaped and extends upwardly from the top surface of step 12. In one embodiment, the hand railing 22 can be, for example, tubular steel similar to that used for legs 16. In one embodiment the hand railing 22 can be an upwardly projecting extension of the rear legs of the stool 10, or can be attached to the rear legs of the stool 10. Brace member 24 extends across the u-shaped hand railing to provide support, and, as will be described below, to provide a convenient storage means for the ramp 14. To provide for the storage of the ramp, brace 24 is provided with a pair of slot openings 26, similar to the slot openings 18 of the step 12.

Figure 2:
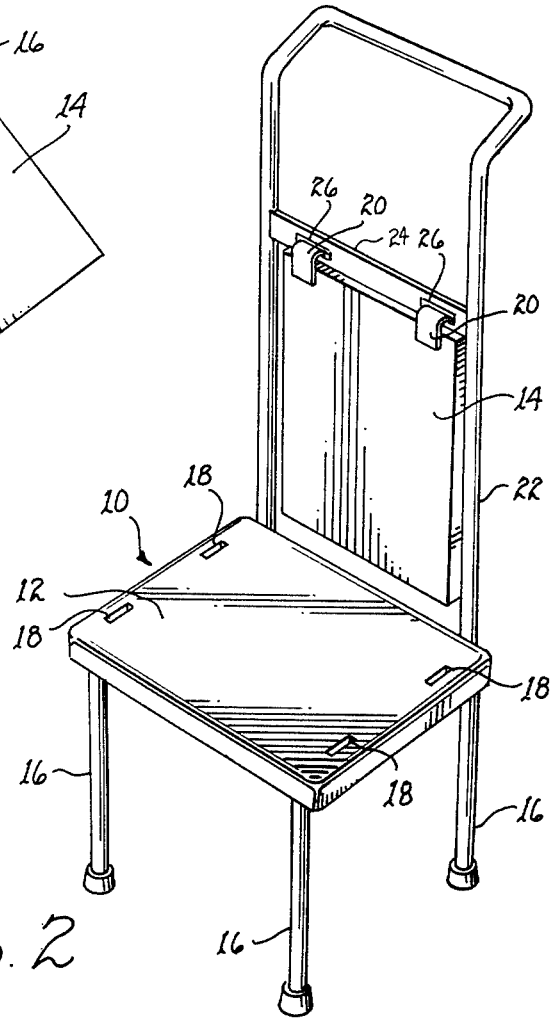
FIG. 2 is a perspective view of a footstool of FIG. 1 showing the ramp in a stored position.

FIG. 2 illustrates the stool 10 in a storage mode. When not in use, ramp 14 can be removed from the stool by disengaging fingers 20 from slot openings 18. To provide a convenient storage for the ramp, when not in use, fingers 20 are then engaged with the slot openings 26 of brace member 24. Ramp 14 is thus conveniently stored out of the way for future use.

To use the footstool, in accordance with the invention, in a preferred embodiment, the footstool is placed against a piece of medical equipment or other apparatus such as an x-ray table, examination table, or the like. The ramp 14 is attached to the seat by engaging fingers 20 and slot openings 18 with the ramp extending outwardly away from the medical equipment. Depending upon which pair of slot openings 18 are used, the hand railing 22 can be on either the left hand or right hand side of the patient mounting the stool. The patient then gradually moves up the ramp, without taking any large steps, until he is able to step onto the step 12. Once on the step 12, the person can sit on the piece of medical equipment and then have his legs swung up onto the equipment, as needed. Support railing 22 can, of course, be used to steady the person as they move up the inclined ramp 14.

Preferably, the footstool, in accordance with the invention, is made of metal, plastic, or the like. The surfaces of step 12 and ramp 14 are preferably covered with a non-skid material such as a rubberized coating to insure that the user moves up the ramp and onto the step without slipping.

Thus, it is apparent that there has been provided, in accordance with the invention, an improved footstool and method for its use which fully meet the objects and advantages set forth above. Although the invention has been described and illustrated by reference to specific embodiments thereof, it is not intended that the invention be limited to these illustrative embodiments. Those skilled in the art will recognize that variations and modifications differing from the illustrative embodiments are possible. For example, the footstool may have other dimensions, be fabricated of different materials, and have a different shaped hand railing. Accordingly, it is intended to include within this invention all such variations and modifications as fall within the scope of the appended claims.

What is claimed is:

1. A footstool comprising:

a top, supporting legs, a removable inclined ramp;

engagement means for attaching an end of said ramp to said top; and an upwardly extending handle and support railing.

2. The footstool of claim 1 wherein said engagement means comprises, in combination:

slot openings at the end of said top; and fingers attached to said ramps near said end insertable into said openings.

3. The footstool of claim 2 further comprising means for storing said ramp on said handle when said stool is not in use.

4. The footstool of claim 3 wherein said handle comprises a generally u-shaped tubular member having two straight portions extending vertically from along one side of said top and having a brace member extending perpendicular to said two straight portions.

5. The footstool of claim 4 wherein said means for storing comprises slot openings in said brace member into which said fingers are insertable to hang said ramp from said brace member.

6. The footstool of claim 1 wherein said ramp comprises a non-skid surface.

7. The footstool of claim 1 wherein said handle and support railing comprises a generally u-shaped tubular member having two straight portions extending vertically from along one side of said top.

8. The footstool of claim 7 wherein said two straight portions comprise extensions of two of said supporting legs.

9. A method for assisting an invalid onto a medical equipment which comprises the steps of:

providing an elevated step;

providing an inclined ramp ascending to said step;

helping said invalid to gradually move up said ramp to said step; and thereafter lifting said invalid from said step onto said equipment.

10. The method of claim 9 further comprising the step of providing a hand railing attached to and extending upwardly from said step.

11. A medical stool comprising:

a step surface;

four legs supporting said step surface above a floor surface;

a removable inclined ramp extending from said floor surface to said step surface;

slots in said step surface along an edge thereof;

fingers extending from said ramp for engagement with said slots to secure said ramp in position and a hand railing extending upwardly from said step surface, said hand railing comprising a u-shaped structure positioned along an edge of said step surface.

12. The stool of claim 11 wherein said step surface comprises a non-skid surface.

13. The stool of claim 11 wherein said ramp surface comprises a non-skid surface.

14. The stool of claim 11 wherein said slots are positioned along each of first and second sides of said step surface to allow said ramp to be secured along a selected one of said first and second sides.

15. The stool of claim 11 further comprising means for securing said ramp when not in use.

16. The stool of claim 15 wherein said means for securing comprises a brace spanning said u-shaped structure and having slots therein to accept said fingers.

17. An improved medical stool for assisting patients onto medical equipment, said stool adapted for placement adjacent to said medical equipment, said improvement comprising a removable ramp member providing an inclined passage from the floor to a step surface of said stool upon which a patient can gradually climb.

18. The improved stool of claim 17 wherein one end of said ramp member is selectively attachable to said step surface by fingers on said ramp member which engage with slot openings provided in said step surface.

19. The improved stool of claim 18 wherein said slot openings are provided along more than one side of said step surface.

* * * * *